US007764903B2

(12) United States Patent
Ishikawa et al.

(10) Patent No.: US 7,764,903 B2
(45) Date of Patent: Jul. 27, 2010

(54) IMAGE FORMING APPARATUS AND PROCESS CARTRIDGE

(75) Inventors: Satoru Ishikawa, Kitanagoya (JP); Junji Uehara, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 125 days.

(21) Appl. No.: 12/201,398

(22) Filed: Aug. 29, 2008

(65) Prior Publication Data

US 2009/0060568 A1 Mar. 5, 2009

(30) Foreign Application Priority Data

Aug. 31, 2007 (JP) ..... 2007-225665

(51) Int. Cl.
*G03G 21/16* (2006.01)

(52) U.S. Cl. ..... 399/111; 399/401

(58) Field of Classification Search ..... 399/107, 399/110, 111, 124, 381, 397, 401
See application file for complete search history.

(56) References Cited

U.S. PATENT DOCUMENTS

| | | | | |
|---|---|---|---|---|
| 7,529,506 | B2 * | 5/2009 | Ogawa | 399/124 |
| 7,542,709 | B2 * | 6/2009 | Uehara et al. | 399/316 |
| 2002/0025187 | A1 | 2/2002 | Sato | |
| 2006/0171760 | A1 | 8/2006 | Deguchi | |
| 2007/0269242 | A1 | 11/2007 | Hattori et al. | |
| 2007/0269243 | A1 | 11/2007 | Uehara et al. | |
| 2007/0269244 | A1 | 11/2007 | Miwa et al. | |

FOREIGN PATENT DOCUMENTS

| | | | |
|---|---|---|---|
| JP | 05-080611 | | 4/1993 |
| JP | 05-297662 | A | 11/1993 |
| JP | 08-211811 | A | 8/1996 |
| JP | 2002-255442 | A | 9/2002 |
| JP | 2004-085977 | A | 3/2004 |
| JP | 2005-195632 | A | 7/2005 |
| JP | 2005-215229 | | 8/2005 |
| JP | 2006-208839 | A | 8/2006 |

OTHER PUBLICATIONS

JP Office Action dtd Aug. 18, 2009, JP Appln. 2007-225665, partial English translation.
Extended EP Search Report dtd Apr. 7, 2010, EP Appln. 08014985.9.

* cited by examiner

*Primary Examiner*—Hoan Tran
(74) *Attorney, Agent, or Firm*—Banner & Witcoff, Ltd.

(57) ABSTRACT

An image forming apparatus includes: a main body; a process cartridge detachably attachable to the main body, the process cartridge including an image carrier configured to carry a developer image thereon and a cartridge frame; a feeding path configured to feed a recording sheet to a transfer position where the developer image carried on the image carrier is transferred to the recording sheet; and a returning path configured to return the recording sheet that has passed the transfer position to the feeding path. The cartridge frame defines at least a part of the feeding path and at least a part of the returning path.

14 Claims, 9 Drawing Sheets

IMAGE FORMING APPARATUS AND PROCESS CARTRIDGE

CROSS-REFERENCE TO RELATED APPLICATIONS

This application is based upon and claims priority from Japanese Patent Application No. 2007-225665 filed on Aug. 31, 2007, the entire contents of which are incorporated herein by reference.

TECHNICAL FIELD

The present invention relates to an image forming apparatus which can double-sided printing and a process cartridge which can be used therein.

BACKGROUND

In general, in an image forming apparatus such as a laser printer, a laser beam emitted from an optical unit is irradiated to a photosensitive drum so as to form an electrostatic latent image on a surface of the photosensitive drum, and toner is supplied to the electrostatic latent image so formed from a development unit. Then, a sheet is conveyed to pass between the photosensitive drum with a toner image formed thereon and a transfer roller to transfer the toner image to the sheet, and the toner image so transferred is heat fixed on the sheet by a fixing unit.

JP-A-2005-215229 discloses an image forming apparatus which can perform double-sided printing. In the image forming apparatus, when the double-sided printing is performed, a discharge roller for conveying the sheet discharged from the fixing unit to the outside of the apparatus is reversed to convey the sheet to a returning path. Then, the sheet is conveyed to pass again between the photosensitive drum and the transfer roller to transfer a toner image to the sheet, and the sheet is discharged to the outside of the apparatus after the toner image so transferred has been fixed on the sheet by the fixing unit.

Incidentally, in the image forming apparatus which can perform double-sided printing, the returning path is independently provided between the transfer roller provided on the main body of the apparatus and a sheet feeding tray provided in a lower portion of the apparatus. Therefore, when the returning path is jammed with a recording sheet, the jammed sheet is not easily removed from the returning path.

SUMMARY

One aspect of the invention has been made in view of the above circumstances and an object thereof is to provide an image forming apparatus and a process cartridge which facilitate an operation to deal with a case where the returning path is jammed with a recording sheet.

According to a first aspect of the invention, there is provided an image forming apparatus comprising: a main body; a process cartridge detachably attachable to the main body, the process cartridge comprising an image carrier configured to carry a developer image thereon and a cartridge frame; a feeding path configured to feed a recording sheet to a transfer position where the developer image carried on the image carrier is transferred to the recording sheet; and a returning path configured to return the recording sheet that has passed the transfer position to the feeding path, wherein the cartridge frame defines at least a part of the feeding path and at least a part of the returning path.

According to a second aspect of the invention, there is provided a process cartridge comprising: an image carrier configured to carry a developer image; and a cartridge frame, wherein the cartridge frame defines at least a part of a feeding path through which a recording sheet is allowed to be fed to a transfer position where the developer image on the imager carrier is transferred to the recording sheet and at least a part of a returning path through which the recording sheet that has passed the transfer position is allowed to be returned to the feeding path.

According to the image forming apparatus and the process cartridge of the above aspects of invention, a part of the returning path is formed at the cartridge frame, which allows an operation to deal with a case where the returning path is jammed with a recoding sheet to easily be implemented.

DESCRIPTION

First Embodiment

Figure 1:
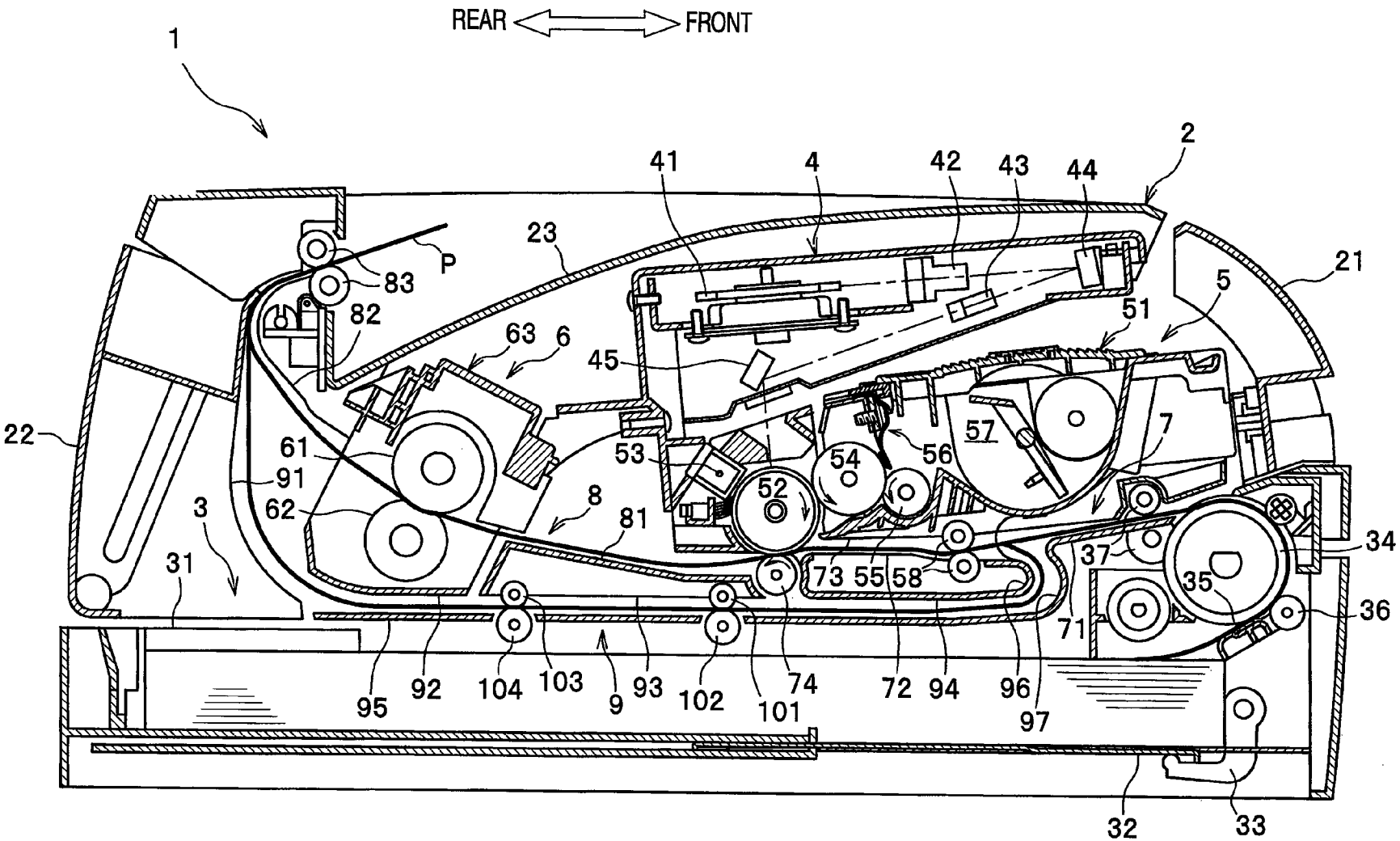
FIG. 1 is a sectional view showing an overall configuration of a laser printer as an example of an image forming apparatus according to a first embodiment.

Next, a first embodiment of the invention will be described in detail while referring to the drawings.

Figure 2:
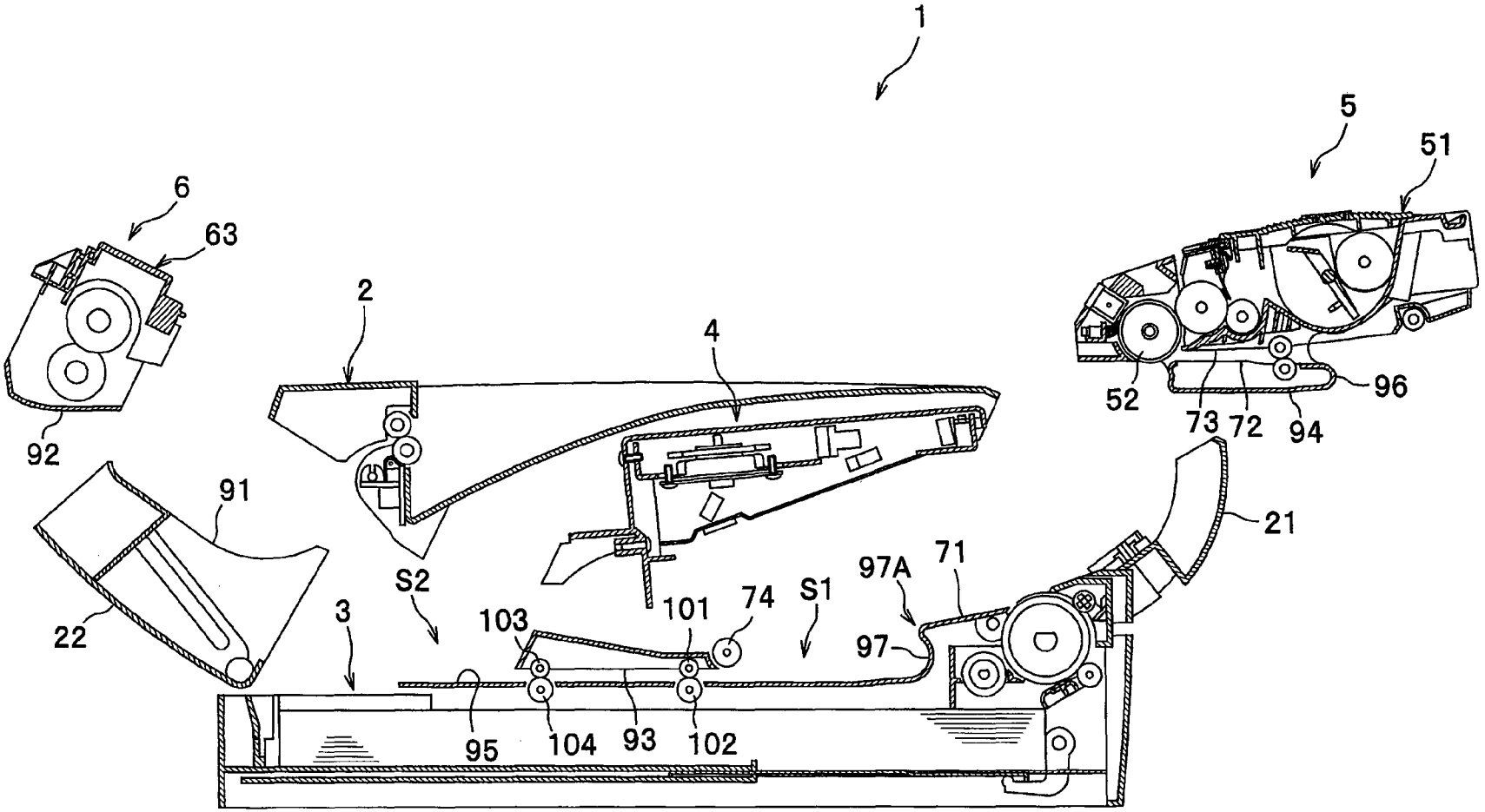
FIG. 2 is a sectional view showing a state in which a process cartridge and a fixing device of the laser printer according to the first embodiment are detached therefrom.
Figure 3:
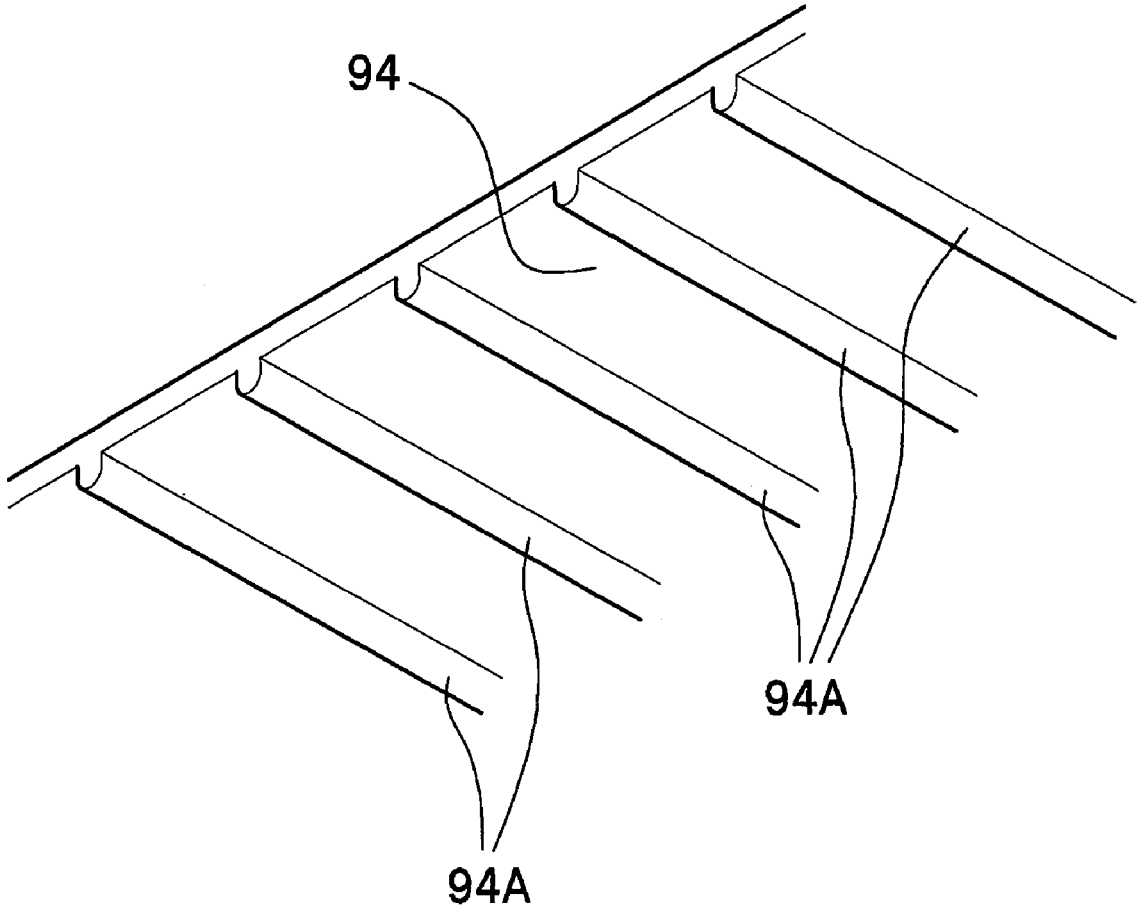
FIG. 3 is a perspective view showing a bottom surface portion of an external wall surface which defines a part of a returning path formed at the process cartridge.

In the drawings to be referred to, FIG. 1 is a sectional view showing an overall configuration of a laser printer as an example of an image forming apparatus according the first embodiment of the invention, and FIG. 2 is a sectional view showing a state in which a process cartridge and a fixing unit are detached from the laser printer according to the first embodiment of the invention. FIG. 3 is a perspective view showing a bottom surface portion of an external wall surface which defines a part of a returning path formed at the process cartridge, and FIGS. 4A to 4D are diagrams which explain an attaching and detaching mechanism of the process cartridge.

Here, in the following description, directions are defined based on directions viewed from the user during the use of the laser printer. Namely, a right side in FIG. 1 is defined as a "front side," a left side in FIG. 1 is defined as a "rear side," a back side of the sheet of FIG. 1 is defined as a "right-hand side," and a near side of the sheet of FIG. 1 is defined as a "left-hand side" of the laser printer. In addition, a vertical direction of the sheet of paper denotes a "vertical direction" of the laser printer. Note that the user is assumed to operate the laser printer from the "front side."

<Overall Configuration of Laser Printer>

As shown in FIG. 1, a laser printer 1 includes: a sheet feeding unit 3 configured to feed a sheet P as an example of a recording sheet into a main body 2; an exposure device 4; a process cartridge 5 (described later) configured to transfer a toner image (a developer image) to a sheet P at a transfer position; a fixing device 6 configured to heat and fix the toner image transferred to the sheet P; a feeding path 7 configured to allow the sheet P to be conveyed from the sheet feeding unit to the transfer position; a sheet discharge path 8 configured to allow the sheet P to be conveyed from the transfer position to the outside of the main body 2; and a returning path 9 configured to allow the sheet P to be conveyed from the sheet discharge path 8 to the feeding path 7.

A front cover 21, which can be opened and closed, is provided on the front side of the main body, and the process cartridge 5 (described later) can be attached and detached through an opening formed when the front cover 21 is opened. A rear cover 22, which can be opened and closed, is provided on the rear side of the main body, and the fixing device 6 (described later) can be attached and detached through an opening formed when the rear cover 22 is opened (see FIG. 2). A sheet discharging tray 23, on which the sheet P discharged from the main body 2 is allowed to be placed, is provided on an upper surface of the main body 2.

<Configuration of Sheet Feeding Unit>

The sheet feeding unit 3 includes: a sheet feeding tray 31 detachably attachable to a lower portion within the main body 2; a sheet pressing plate 32 provided at a lower portion of the sheet feeding tray 31 and being swingable such that a front side of the seat pressing plate can be lifted; and a lift lever 33 configured to lift up the sheet pressing plate 32 from a lower side thereof. The sheet feeding unit 3 further includes: a sheet feeding roller 34 and a sheet feeding pad 35 which are provided above the front side of the sheet feeding tray 31; and a pinch roller 36 provided to oppose the sheet feeding roller 34. Further, the sheet feeding unit 3 includes registration rollers 37 provided on the rear side of the sheet feeding roller 34.

<Configuration of Exposure Device>

The exposure device 4 is provided in an upper portion within the main body 2 and includes: a laser emitting unit (not shown); a polygon mirror 41 which is driven to rotate; lenses 42, 43; and reflection mirrors 44, 45. A laser beam formed based on image data emitted from the laser emitting unit and then reflected on or passes through, as indicated by a chain line, the polygon mirror 41, the lens 42, the reflection mirror 44, the lens 43 and the reflection mirror 45 in this order and is irradiated to a surface of a photosensitive drum 52 of the process cartridge 5 through high-speed scanning.

<Configuration of Process Cartridge>

The process cartridge 5 is provided below the exposure device 4 and is detachably attachable to the main body 2 (see FIG. 2). The process cartridge 5 includes a hollow cartridge frame 51 which defines an outer frame. The process cartridge 5 further includes: the photosensitive drum 52 as an example of an image carrier; a scorotron charger 53; a developing roller 54; a feed roller 55; a layer thickness control blade 56; a toner storage unit 57; and conveyer rollers 58, which are provided in the cartridge frame 51. Of these elements, the photosensitive drum 52, the developing roller 54, the feed roller 55 and the conveyer rollers 58 are rotatably supported on the cartridge frame 51.

A developer, e.g., toner in this embodiment, is stored in the toner storage unit 57. The toner is fed to the developing roller 54 by the rotation of the feed roller 55 in a direction indicated by an arrow (in a counterclockwise direction). As this occurs, the toner is friction charged positively. The toner fed to the developing roller 54 enters between the layer thickness control blade 5 and the developing roller 54 in association with the rotation of the developing roller 54 in a direction indicated by an arrow (in a counterclockwise direction) and is then carried on the developing roller 54 in the form of a thin layer having a constant thickness.

A drum main body of the photosensitive drum 52 is earthed, and a surface portion thereof includes a positively charged photosensitive layer.

The scorotron charger 53 is disposed above the photosensitive drum 52 to face the photosensitive drum 52 with a predetermined space defined therebetween such that the scorotron charger 53 is not brought into contact with the photosensitive roller 52. This scorotron charger 53 is configured to positively charge the surface of the photosensitive drum 52 uniformly.

<Configuration of Fixing Device>

The fixing device 6 is provided on a rear side (a downstream side in the conveying direction of the sheet P) of the process cartridge 5 and is detachably attachable to the main body 2 (see FIG. 2). This fixing device 6 includes: a heating roller 61 as an example of the heating member; a pressure roller 62 which is disposed to oppose the heating roller 61 such that the sheet P can be held between the heating roller 61 and the pressure roller 62; and a frame member 63 which supports rotatably the heating roller 61 and the pressure roller 62.

<Configuration of Feeding Path>

The feeding path 7 is a conveying path for conveying the sheet P from the sheet feeding tray 31 of the sheet feeding unit 3 to the transfer position (described later) and is mainly defined by guide walls 71 to 73. On the feeding path 7, the sheet feeding roller 34, the sheet feeding pad 35, the pinch roller 36, the registration rollers 37 and a transfer roller 74 as an example of the transfer member are disposed.

The guide wall 71 defines a part of a lower wall of the feeding path 7 which is provided below a front side of the process cartridge 5 in the main body 2.

The guide wall 72 defines a part of the lower wall of the feeding path 7 such that the feeding path 7 continues from the guide wall 71 to a rear side of the guide wall 71. This guide wall 72 is a lower wall of a through hole (whose reference numeral is omitted) provided in the cartridge frame 51 from the front side towards the transfer position.

The guide wall 73 is provided above the guide walls 71, 72 to oppose the guide walls 71, 72 and defines an upper wall of the feeding path 7. This guide wall 73 is also define an upper wall of the through hole. The conveyer rollers 58 are provided on the guide walls 72, 73 to oppose and contact each other between the registration rollers 37 and the transfer roller 74. In addition, the guide walls 72, 73 define a feeding path (a part of the feeding path 7) which is formed in the cartridge frame 51.

The transfer roller 74 is supported rotatably on the main body 2 and is disposed below the photosensitive drum 52 of the process cartridge 5 when it is attached (see FIG. 1) to oppose and contact the photosensitive drum 52. A transfer bias is applied to this transfer roller 74 through a constant current control at the time of transfer.

Note that in the embodiments, the position where the photosensitive drum 52 and the transfer roller 74 oppose and contact each other, that is, the position where a toner image on the photosensitive drum 52 is transferred to the sheet P is referred to as the "transfer position."

<Configuration of Sheet Discharging Path>

The sheet discharging path 8 is a conveying path of the sheet P from the transfer position to the outside (the sheet discharging tray 23) and is mainly defined by guide walls 81, 82. Sheet discharging rollers 83 are disposed at an exit of the sheet discharging path 8 from the main body 2. The sheet discharging rollers 83 are reversibly rotatable. In addition, the fixing device 6 is disposed on the sheet discharging path 8, and the sheet P conveyed from the transfer position enters the fixing device 6 along the guide wall 81, after the toner image has been transferred thereto in the transfer position, the sheet P is returned along the guide wall 82 from the rear side to the front side, and the returned sheet P is discharged to the sheet discharging tray 23 from the sheet discharging rollers 83. When double-sided printing is performed, the sheet discharging rollers 83 are caused to rotate reversely before the sheet P has completely been discharged to the outside of the main body 2, so that the sheet P is conveyed to the return path 9 (described later). In addition, conveyer rollers or the like may be provided along the sheet discharging path 8 as required.

<Configuration of Returning Path>

The returning path 9 is a conveying path of the sheet P from the sheet discharging path 8 to the feeding path 7 and is mainly defined by a guide wall 91 which is formed on a rear side of an interior of the main body 2, guide walls 92 to 94 which defines an upper wall which extends in a direction oriented towards the front side and the rear side (hereinafter, referred to as a longitudinal direction), a guide wall 95 which opposes the guide walls 92 to 94 and defines a lower wall, and curved portions 96, 97 which changes the conveying direction of the sheet P to return it to the feeding path 7. Conveyer rollers 101 to 104 are disposed along this returning path 9.

The guide wall 91 is defined by an inner wall surface of the rear cover 22 which is located on the rear side of the interior of the main body 2 and has a function to guide the sheet P which is conveyed by the sheet discharging rollers 83 which are rotating reversely to a longitudinally extending portion of the returning path 9, that is, between the guide wall 92 and the guide wall 95.

The guide wall 92 is defined by a bottom surface portion of an outer wall surface of a frame member 63 of the fixing device 6. Namely, in this embodiment, a part of the returning path 9 is formed on the frame member 63 of the fixing device 6.

The guide wall 93 is provided on a front side of the guide wall 92 within the main body 2 and defines a part of the upper wall of the returning path 9. Conveyer rollers 101, 103 are provided on the guide wall 93 in that order from the front side.

The guide wall 94 is provided upstream of the transfer position (on a front side of the transfer roller 74) in a conveying direction (the longitudinal direction) in the feeding path 7 and is defined by a bottom surface portion of an outer wall surface of the cartridge frame 51. Namely, in this embodiment, the outer wall surface of the cartridge frame 51 forms one side wall (apart of the upperwall) of the returning path 9.

As shown in FIG. 3, a plurality of ribs 94A are provided on the guide wall 94 (a surface facing to the sheet P) extending along the conveying direction of the sheet P (the longitudinal direction). By this configuration, since the contact area between the guide wall 94 and the sheet P can be reduced, adhesion of the sheet P, which is being conveyed, to the guide wall 94 can be suppressed effectively.

The guide wall 95 is a lower wall of the returning path 9 which is provided within the main body 2 and is provided to oppose the guide walls 92 to 94. On this guide wall 95, a conveyer roller 102, which opposes and contacts the conveyer roller 101, and a conveyer roller 104, which opposes and contacts the conveyer roller 103, are provided in that order from the front side.

The curved portions 96, 97 are portions where the conveying direction of the sheet P which has been conveyed along the guide walls 91 to 95 of the returning path 9 is changed from the front side to the rear side so as to return the sheet P to the feeding path 7.

Figure 4A:
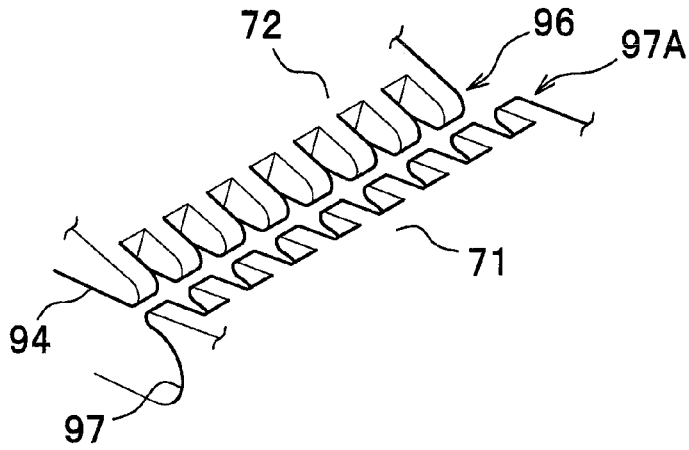
FIGS. 4A to 4D are diagrams which explain an attaching and detaching mechanism of the process cartridge.

The curved portion 96 is provided to curve upwards from a front side of the guide wall 94 which is the outer wall surface of the cartridge frame 51 and further curve to a rear side thereof to continue to the guide wall 72. As shown in FIG. 4A, a comb-shaped portion is formed in a width or transverse direction thereof.

The curved portion 97 extends upwards from a front side of the guide wall 95 in an arc shape and then continues to a rear side of the guide wall 71, and opposes the curved portion 96 of the cartridge frame 51 with a predetermined space. As shown in FIG. 4A, a comb-shaped portion is formed at an upper portion 97A of the curved portion 97 in a width or transverse direction thereof. The comb-shaped portion of the upper portion 97A and the comb-shaped portion of the curved portion 96 are formed in a zigzag or staggering fashion to such an extent that recessed portions at the comb-shaped portion of the upper portion 97A do not contact protruding portions at the comb-shaped portion of the curved portion 96*a*, whereas protruding portions at the comb-shaped portion of the upper portion 97A do not contact recessed portions at the comb-shaped portion of the curved portion 96.

Figure 4B:
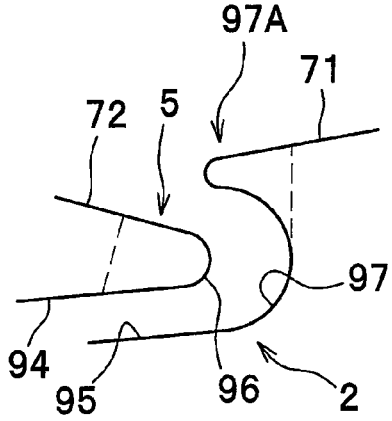
Figure 4C:
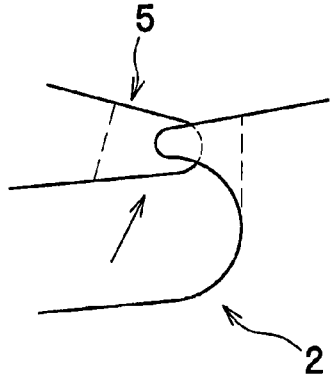
Figure 4D:
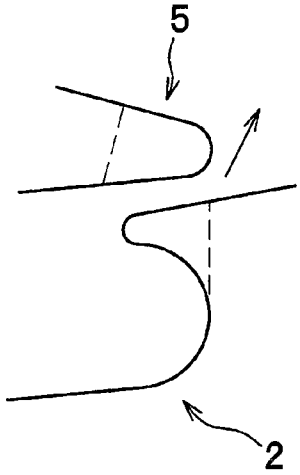

By providing the comb-shaped portions, as shown in FIGS. 4B to 4D, the cartridge frame 51 can be released from the attached state by causing the protruding portions of the comb-shaped portion of the curved portion 96 to pass through the recessed portions of the comb-shaped portion of the upper portion 97A. By this configuration, as shown in FIG. 2, the process cartridge 5 can be removed from the main body 2 on the upstream side in the conveying direction of the feeding path (on the front side).

The conveyer rollers 101 to 104 convey the sheet P in the returning path 9.

Here, driving force transmission mechanisms of the conveyer rollers 101 to 104 will be described. In the drawings to which are referred, FIG. 5A is a diagram explaining a driving force transmission mechanism of a first conveyer roller, FIG. 5B is a diagram showing the driving force transmission mechanism of the first conveyer roller in such a state that the process cartridge is removed, FIG. 5C is a diagram explaining a driving force transmission mechanism of a second conveyer roller, and FIG. 5D is a diagram showing the driving force transmission mechanism of the second conveyer roller in such a state that the fixing device is removed.

Figure 5A:
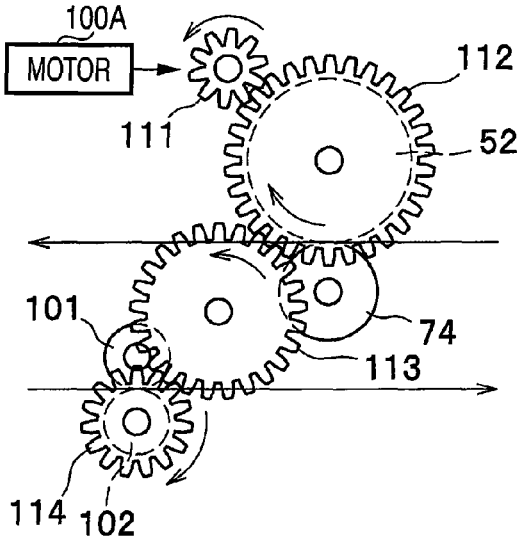
FIG. 5A is a diagram which explains a driving force transmission mechanism of a first conveyer roller.
Figure 5B:
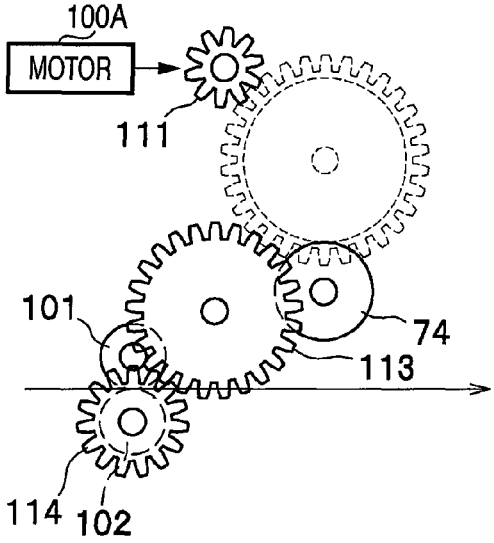
FIG. 5B is a diagram showing the driving force transmission mechanism of the first conveyer roller in such a state that the process cartridge is removed.
Figure 5C:
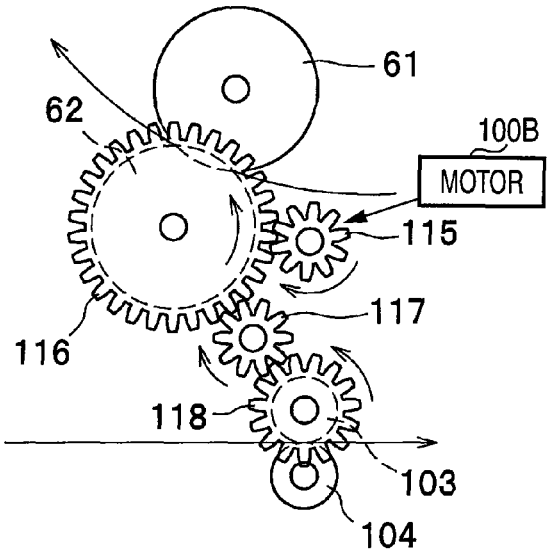
FIG. 5C is a diagram which explains a driving force transmission mechanism of a second conveyer roller.
Figure 5D:
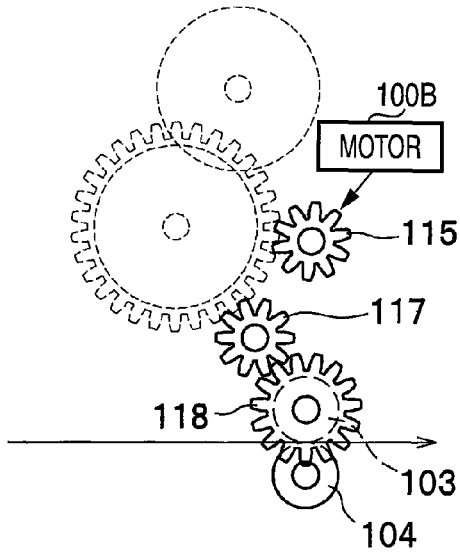
FIG. 5D is a diagram showing the driving force transmission mechanism of the second conveyer roller in such a state that the fixing device is removed.

As shown in FIG. 5A, the driving force transmission mechanism of the conveyer rollers 101, 102 includes a drive gear 111, a drum gear 112, an intermediate gear 113 and a roller gear 114.

The drive gear 111 receives driving force generated by a motor 100A as a drive source provided within the main body 2 via a plurality of gears (not shown). The drive gear 111 is located in the vicinity of the photosensitive drum 52 of the process cartridge 5 when the process cartridge 5 is attached to the main body 2.

The drum gear 112 is fixed to an axial end of the photosensitive drum 52 and rotates together with the conveyer roller 102.

The intermediate gear 113 meshes with the drum gear 112 and the roller gear 114 and is supported rotatably within the main body 2.

The roller gear 114 is fixed to an axial end of the conveyer roller 102 and rotates together with the conveyer roller 102.

In this embodiment, the plurality of gears (not shown) which transmit the driving force of the motor 100A to the drive gear 111, the drive gear 111 and the drum gear 112 serve as an example of a first driving force transmission unit. In addition, the intermediate gear 113 and the roller gear 114 serve as an example of a second driving force transmission unit, and the conveyer roller 102 serves as an example of a first conveyer roller.

Next, the operation of the driving force transmission mechanism of the conveyer rollers 101, 102 will be described. Firstly, the drive gear 111 rotates to which the driving force is transmitted from the motor 100A, and the drum gear 12, which meshes with the drive gear 111, rotates. In association with this, the photosensitive drum 52 is driven to rotate, and the transfer roller 74, which opposes and contacts the photosensitive drum 52, is driven to rotate. In addition, the intermediate gear 113, which meshes with the drum gear 112, rotates by the rotation of the drum gear 112, and furthermore, the roller gear 114 which meshes with the intermediate gear 113 rotates. In association with this, the conveyer roller 102 is driven to rotate and the conveyer roller 101 which opposes and contacts the conveyer roller 102 is driven to rotate.

In the driving force transmission mechanism of the conveyer rollers 101, 102, when the process cartridge 5 is detached from the main body 2, the conveyer rollers 101, 102 can freely rotate. Specifically, as shown in FIG. 5B, since the drum gear 112 is removed when the process cartridge 5 is removed, the mesh engagement of the drum gear 112 with the drive gear 111 and the intermediate gear 113 is released, whereby the load exerted on the roller gear 114 (the conveyer roller 102) is eliminated.

As shown in FIG. 5C, the driving force transmission mechanism of the conveyer rollers 103, 104 includes a drive gear 115, a pressure roller gear 116, an intermediate roller 117 and a roller gear 118.

The drive gear 115 receives driving force generated from a motor 100B provided within the main body 2 as a drive source via a plurality of gears (not shown). The drive gear 115 is provided in the vicinity of the pressure roller 62 of the fixing device 6 when the fixing device 6 is attached to the main body 2.

The pressure roller gear 116 is fixed to an axial end of the pressure roller 62 and rotates together with the pressure roller 62. This pressure roller gear 116 meshes with the drive gear 115.

The intermediate gear 117 meshes with the pressure roller gear 116 and the roller gear 118 and is supported rotatably within the main body 2.

The roller gear 118 is fixed to an axial end of the conveyer roller 103 and rotates together with the conveyer roller 103.

In this embodiment, the plurality of gears (not shown) which transmits the driving force of the motor to the drive gear 115, the drive gear 115 and the pressure roller gear 116 serve as a third driving force transmission unit. In addition, the intermediate gear 117 and the roller gear 118 serve as a fourth driving force transmission unit, and the conveyer roller 103 serves as a second conveyer roller.

Next, the operation of the driving force transmission mechanism of the conveyer rollers 103, 104 will be described. Firstly, the drive gear 115 rotates to which the driving force of the motor 100B is transmitted, and the pressure roller gear 116 which meshes with the drive gear 115 rotates. In association with this, the pressure roller 62 is driven to rotate, and the heating roller 61 which is disposed to oppose the pressure roller 62 is driven to rotate. In addition, the intermediate gear 117, which meshes with the pressure roller gear 116, rotates by the rotation of the pressure roller gear 116, and furthermore, the roller gear 118, which meshes with the intermediate gear 117, rotates. In association with this, the conveyer roller 103 is driven to rotate, and the conveyer roller 104, which opposes and contact the conveyer roller 103, is driven to rotate.

In addition, also in the driving force transmission mechanism of the conveyer rollers 103, 104, when the fixing device 6 is removed from the main body 2, the conveyer rollers 103, 104 can freely rotate. Specifically, as shown in FIG. 5D, the pressure roller gear 116 is also removed when the fixing device 6 is removed, the mesh engagement of the pressure roller gear 116 with the drive gear 115 and the intermediate gear 117 is released, whereby the load exerted on the roller gear 118 (the conveyer roller 103) is eliminated. In the embodiment, separate motors may be provided for the motor 100A and the motor 100B, or a common motor may be used for the motor 100A and the motor 100B.

<Operation of Laser Printer>

Next, the operation of the laser printer 1 when double-sided printing is performed will be described briefly.

Firstly, sheets P within the sheet feeding tray 31 are lifted up by means of the lift lever 33 and the sheet pressing plate 32 so as to approach the sheet feeding roller 34 side, are then fed out sheet by sheet by the sheet feeding roller 34 and the sheet feeding pad 35. The sheet P is eventually conveyed to the transfer position after having passed the pinch roller 36, the registration rollers 37 and the conveyer rollers 58.

In addition, the surface of the photosensitive drum 52 is uniformly positively charged by the scorotron charger 53, and thereafter, the surface of the photosensitive drum 52 is exposed by a laser beam from the exposure device 4 through high-speed scanning, whereby the potential of the exposed portions is lowered, and an electrostatic latent image based on image data is formed on the photosensitive drum 52. Then, toner carried on the developing roller 54 is fed to the electrostatic latent image formed on the photosensitive drum 52 when the developing roller 54 opposes and contacts the photosensitive drum 52, whereby the electrostatic latent image on the photosensitive drum 52 is visualized so as to form a toner image.

Next, by conveying the sheet P, which has been conveyed along the feeding path 7, between the photosensitive drum 52 which carries the toner image on the surface thereof and the transfer roller 74, the toner image on the photosensitive drum 52 is transferred to the sheet P in the transfer position. Thereafter, the sheet P is conveyed on the guide wall 81 to enter the fixing device 6, and the toner image transferred to the sheet P is heat fixed on the sheet P while the sheet P is passing between the heating roller 61 and the pressure roller 62. The sheet P that has been conveyed from the fixing device 6 is conveyed on the guide wall 82 and is then fed into the main body 2 again at a point in time at which a part of the sheet P has been discharged from the sheet discharging rollers 83 to the outside of the main body 2 by the reverse rotation of the sheet discharging rollers 83.

The sheet P that has been fed into the main body 2 again is conveyed along the guide wall and then is conveyed between the guide wall 92 and the guide wall 95. The sheet P then passes through the conveyer rollers 103, 104 and the conveyer rollers 101, 102. Then, the conveying direction of the sheet P is changed in the curved portions 96, 97 from the front side to the rear side and the sheet P is fed to the front side of the conveyer rollers 58. As this occurs, the sheet P is positioned such that the surface on which the toner image is formed is faced down, while a blank surface thereof is faced up.

Then, a toner image carried on the photosensitive drum 52 is transferred to the sheet P at the transfer position, the sheet P on which the toner image so transferred is conveyed on the guide wall 81 to the fixing device 6, where the toner image is heat fixed on the sheet P, and the sheet P is conveyed on the guide wall 82 so as to be discharged to the sheet discharging tray 23 from the sheet discharging rollers 83.

Thus, the following advantages can be obtained in this embodiment.

As shown in FIG. 2, the guide wall 94 and the curved portion 6 which define the side wall (a part) of the returning path 9 can be removed from the inside of the main body 2 by removing the process cartridge 5. By this action, since a space portion S1 is formed where the side wall (the upper wall) is not present on the returning path 9 in the main body 2, a sheet P jammed in the returning path 9 can be removed easily from this space portion S1. Similarly, since the guide wall 92 can be removed by removing the fixing device 6 to thereby form a space portion S2, a sheet P jammed in the returning path 9 can easily be removed from this space portion S2.

In addition, since the meshing engagement of the driving gear 111 or 115 with the roller gear 114 or 118 is released when the process cartridge 5 or the fixing device 6 is removed so that the conveyer rollers 101, 102 or 103, 104 can freely rotate, the sheet P jammed can easily be pulled out to be removed from the space portion S1 or S2.

Since the guide wall 94 and the curved portion 96 which define the part of the returning path 9 are provided upstream of the transfer position (on the front side of the transfer roller 74) in the conveying direction (the longitudinal direction) in the feeding path 7 of the cartridge frame 51, the sheet P jammed can be removed from the front side when the process cartridge 5 is removed. In addition, since it is configured that the sheet P can be removed from the front side and that the attaching and detaching (replacement) of the process cartridge 5 can be implemented on the upstream side (the front side) in the conveying direction of the feeding path 7, the operability on the front side (the side where the user operates the laser printer 1) is increased.

Since the bottom surface portion of the external wall surface of the cartridge frame 51 defines the part (the guide wall 94) of the returning path 9, a space between the feeding path 7 and the returning path 9 can be smaller than a space between the feeding path and the returning path of the conventional apparatus, whereby since the process cartridge 5 can be made thinner in thickness and smaller in size, the main body 2 (the laser printer 1) can be made thinner in thickness and smaller in size accordingly.

Second Embodiment

Next, a second embodiment of the invention will be described in detail while referring to the drawings. In addition, since this embodiment is such that a part of the configuration of the first embodiment, specifically, the configurations of the process cartridge 5, the fixing device 6 and the returning path 9 thereof are mainly modified, the same reference numerals will be imparted to similar elements to those of the first embodiment, and the description thereof will be omitted here.

Figure 6:
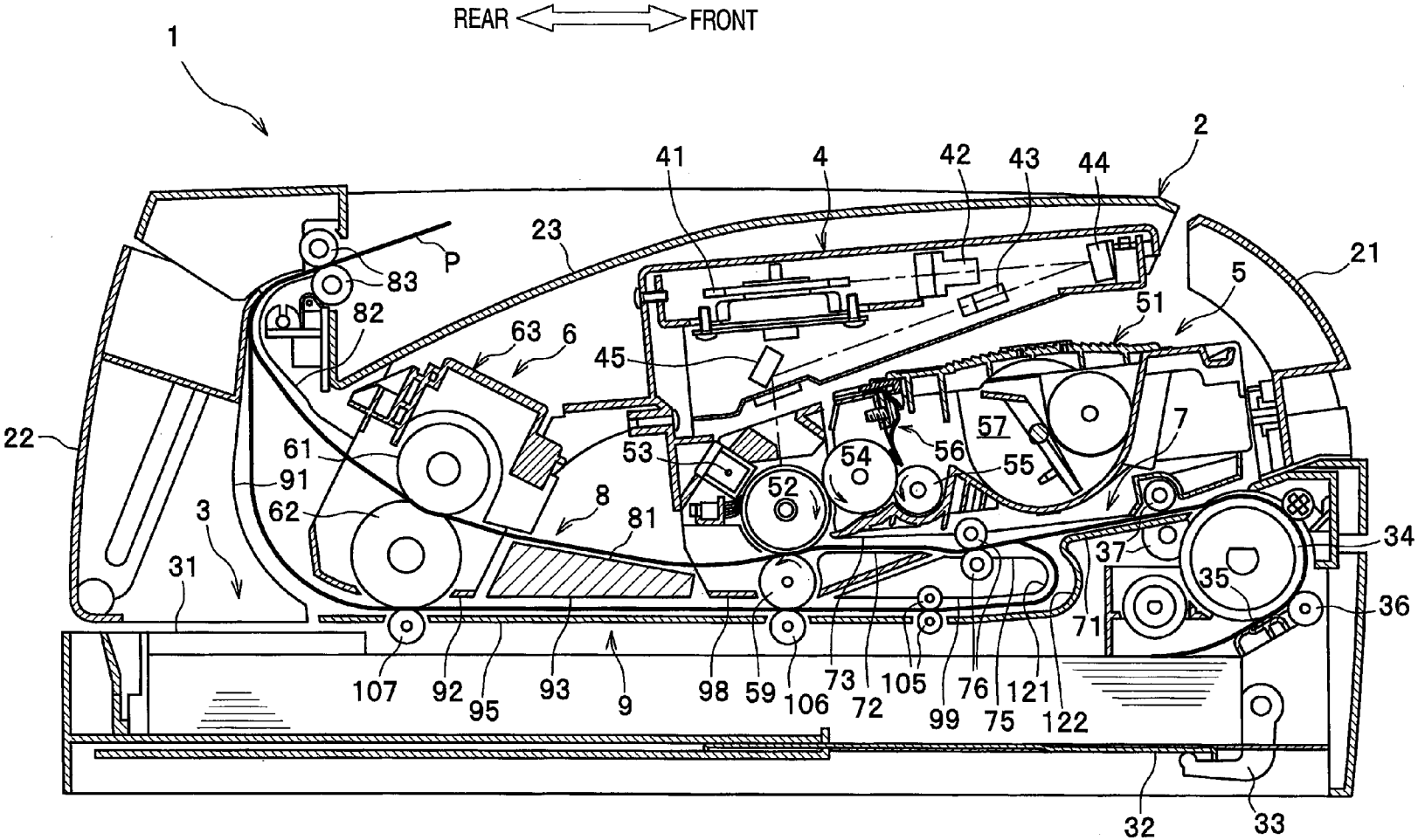
FIG. 6 is a sectional view showing an overall configuration of a laser printer according to a second embodiment.
Figure 7:
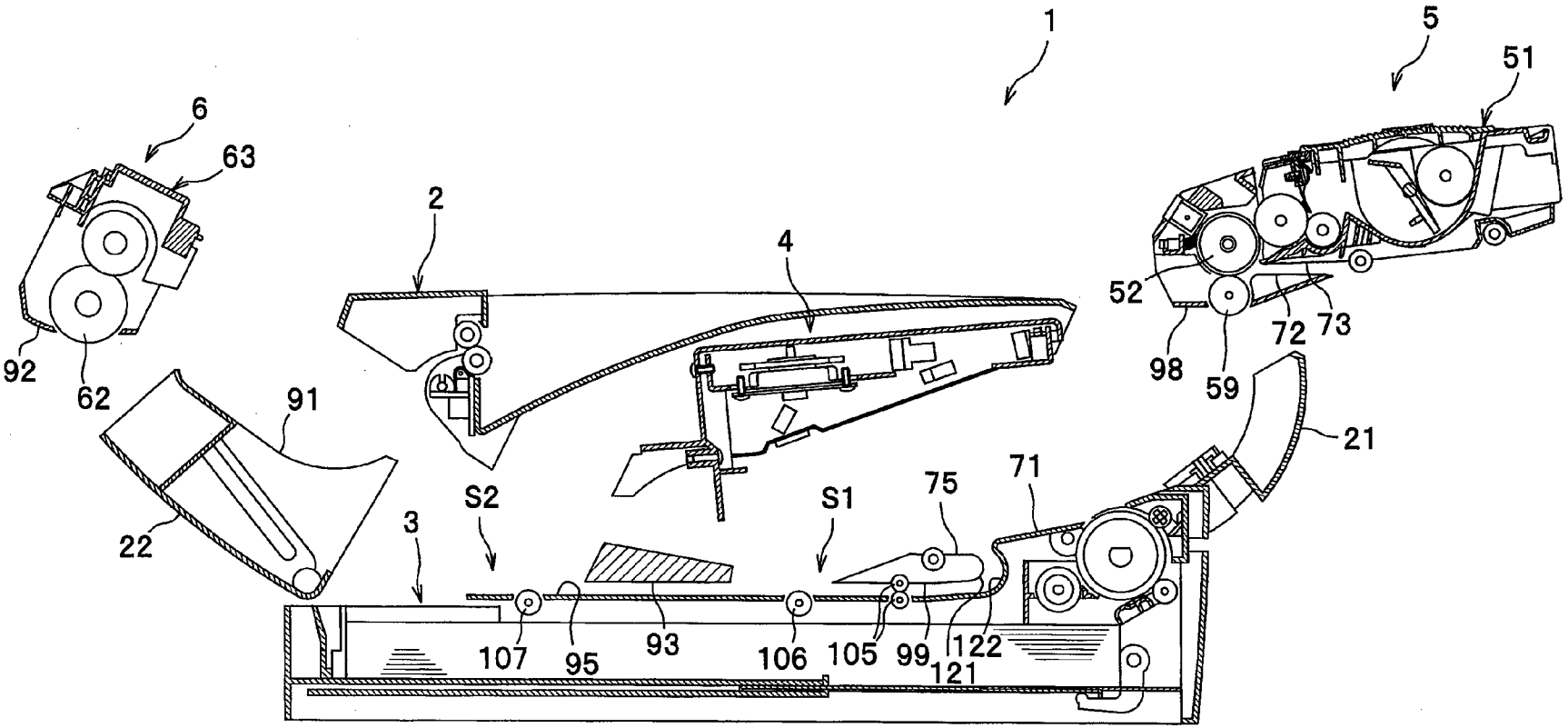
FIG. 7 is a sectional view showing a state in which a process cartridge and a fixing device of the laser printer according to the second embodiment are detached therefrom.

In the drawings which are referred to, FIG. 6 is a sectional view showing an overall configuration of a laser printer according the second embodiment of the invention, and FIG. 7 is a sectional view showing a state in which a process cartridge and a fixing unit are detached from the laser printer according to the second embodiment of the invention.

<Configuration of Process Cartridge>

As shown in FIG. 6, a process cartridge 5 of this embodiment includes in a cartridge frame 51 mainly a photosensitive drum 52, a scorotron charger 53, a developing roller 54, a feeding roller 55, a layer thickness control blade 56, a toner storage unit 57 and a transfer roller 59.

The transfer roller 59 is supported rotatably on the cartridge frame 51 and is disposed below the photosensitive drum 52, as with the transfer roller 74 of the first embodiment 1, to oppose and contact the photosensitive drum 52, and a transfer bias is applied to the transfer roller 59 through constant current control at the time of transfer. In the cartridge frame 51 of this embodiment, an opening is provided in a bottom surface portion of an external wall surface through which a lower portion of the transfer roller 59 is exposed, and the lower portion of the transfer roller 59 is disposed on a returning path 9, which will be described later.

In this embodiment, as well, the position where the photosensitive drum 52 and the transfer roller 59 oppose and contact each other (the position where a toner image on the photosensitive drum 52 is transferred to a sheet P) is referred to as a "transfer position." As shown in FIG. 7, the process cartridge 5 of this embodiment can also be removed from a main body 2 on an upstream side (a front side) of a feeding path 7 in a conveying direction.

<Configuration of Fixing Device>

The fixing device 6 of this embodiment includes a heating roller 61, a pressure roller 62, and a frame member 63 which supports rotatably the heating roller 61 and the pressure roller 62. An opening is provided in a bottom surface portion of an external wall surface of the frame member 63 through which a lower portion of the pressure roller 62 is exposed. In addition, as shown in FIG. 7, the fixing device 6 of this embodiment can be removed from the main body 2 on a rear side thereof.

<Configuration of Returning Path>

The returning path 9 of this embodiment is mainly defined by a guide wall 91; guide walls 92, 93, 98, 99 which define an upper wall extending in the longitudinal direction; a guide wall 95 which opposes the guide walls 92, 93, 98, 99 to define a lower wall; and curved portions 121, 122 where the conveying direction of a sheet P is changed so that the sheet P is returned to a feeding path 7. Conveyer rollers 105 to 107 are disposed on this returning path 9. Note that the aforesaid conveyer rollers 101 to 104 (see FIG. 1) may be further provided.

The guide wall 92 of this embodiment is, as with the first embodiment, defined by the bottom surface portion of the external wall surface of the frame member 63 of the fixing device 6. As has been described above, the opening is provided in the bottom surface portion (the guide wall 92) of the frame member 63 and the lower portion of the pressure roller 62 is disposed on the returning path 9. The pressure roller 62 opposes and contacts the conveyer roller 107 provided on the guide wall 95 from thereabove, and the conveyer roller 107 is driven to rotate by the rotation of the pressure roller 62, whereby the sheet P is conveyed from the rear side to the front side.

The guide wall 98 is provided on a front side of the guide wall 93 or downstream of the transfer position (on a rear side of the transfer roller 59) in the conveying direction (the longitudinal direction) in the feeding path 7 and is defined by the bottom surface portion of the external wall surface of the cartridge frame 51. Namely, in this embodiment, as well, the external wall surface of the cartridge frame 51 forms one side wall (a part of the upper wall) of the returning path 9.

The guide wall 98, that is, the returning path formed at the cartridge frame 51 is provided on an opposite side (a lower side) of the photosensitive drum 52 across the transfer roller 59. As has been described above, the opening is provided in the bottom surface portion of the cartridge frame 51 of the embodiment, and the lower portion of the transfer roller 59 is disposed on the returning path 9. The transfer roller 59 opposes and contacts the conveyer roller 106 provided on the guide wall 95 from thereabove, that is, on the opposite side of the photosensitive drum 52, whereby the conveyer roller 106 is driven to rotate by the rotation of the transfer roller 59, so that the sheet P is conveyed from the rear side to the front side. Note that while a transfer bias is applied to the transfer roller 59 at the time of transfer, no transfer bias is desirably applied to the transfer roller 59 at the time of conveyance so that unnecessary charges are not accumulated on the sheet P.

The guide wall 99 is provided on a front side of the guide wall 98 within the main body and defines a part of the upper wall of the returning path 9. A pair of conveyer rollers 105 is provided on the guide wall 99 and the guide wall 95.

The curved portions 121, 122 are portions where the conveying direction of the sheet P which has been conveyed along the returning path 9 is changed from the front side to the rear side so that the sheet P is returned to the feeding path 7, and in this embodiment, both the curved portions are provided at the main body 2. The curved portion 121 is provided to curve upwards and then further curve to the rear side from a front side of the guide wall 99 so as to continue to a guide wall 75. In addition, the curved portion 122 is provided in such a manner as to extend upwards in an arch shape from a front side of the guide wall 95 so as to continue further to a rear side of a guide wall 71 and is provided to oppose the curved portion 121 with a constant space held therebetween.

<Operation of Laser Printer>

Next, the operation of the laser printer 1 according to the second embodiment will be described briefly.

Firstly, sheets P within a sheet feeding tray 31 are fed out sheet by sheet by a left lever 33, a sheet pressing plate 32, a sheet feeding roller 34 and a sheet feeding pad 35 and pass through a pinch roller 36, registration rollers 37 and conveyer rollers 76 provided on the guide wall 75 of the feeding path 7 to thereby be conveyed to the transfer position.

Then, by conveying the sheet P between the photosensitive drum 52 which carries a toner image on a surface thereof and the transfer roller 59, the toner image on the photosensitive drum 52 is transferred to the sheet P in the transfer position. Thereafter, the toner image transferred to the sheep P is heat fixed on the sheet P while the sheet P is passing between the heating roller 61 and the pressure roller 62 of the fixing device 6. When a part of the sheet P is discharged to the outside of the main body 2 from sheet discharging rollers 83 after it has been conveyed on a guide wall 82, the sheet P is fed into the main body 2 again by the sheet discharge rollers 83 being caused to rotate in a reverse direction.

The sheet P that has been fed into the main body 2 is conveyed along the guide wall 91 and then is conveyed between the guide wall 92 and the guide wall 95. The sheet P then passes between the pressure roller 62 and the conveyer roller 107. The sheet P is then conveyed between the guide walls 93, 98 and the guide wall 95 and passes between the transfer roller 59 and the conveyer roller 106 and between the conveyer rollers 105, and the conveying direction of the sheet P is changed from the front side to the rear side at the curved portions 121, 122, whereby the sheet P is fed to a front side of the conveyer rollers 76 of the feeding path 7.

Then, the toner image carried on the photosensitive drum 52 is transferred to the sheet P at the transfer position, and the toner image so transferred to the sheet P is then heat fixed on the sheet P at the fixing device 6. The sheet P is then discharged from the sheet discharging rollers 83 to a sheet discharging tray 23.

Thus, the following advantages can be obtained in this embodiment.

As shown in FIG. 7, the guide wall 98 which defines the side wall (a part) of the returning path 9 can be removed from the inside of the main body 2 by removing the process cartridge 5. By this action, since a space portion S1 is formed where the side wall is not present on the returning path 9 in the main body 2, a sheet P jammed in the returning path 9 can be removed easily from this space portion S1. Similarly, since the guide wall 92 can be removed by removing the fixing device 6 to thereby form a space portion S2, a sheet P jammed in the returning path 9 can easily be removed from this space portion S2.

In addition, since the transfer roller 59 and the pressure roller 62 are also removed by removing the process cartridge 5 and the fixing device 6, the conveyer rollers 106, 107 which are driven to rotate by rotations of the transfer roller 59 and the pressure roller 62 can freely rotate, whereby the sheet P jammed can easily be pulled out to be removed from the space portion S1 or S2.

Since the guide wall 98 which defines the part of the returning path 9 is provided downstream of the transfer position (on the rear side of the transfer roller 59) in the conveying direction (the longitudinal direction) in the feeding path 7 of the cartridge frame 51, the sheet P jammed on the rear side than the transfer position in the returning path 9 can be removed.

In addition, since it is configured that the attaching and detaching of the process cartridge 5 can be implemented on the upstream side (the front side) in the conveying direction of the feeding path 7, the replacement of the process cartridge 5 can be facilitated.

The bottom surface portions of the cartridge frame 51 and the frame member 63 define the part (the guide walls 92, 98) of the returning path 9, and the transfer roller 59 and the pressure roller 62 can be used as conveyer rollers in the returning path 9. Accordingly, a space between the feeding path 7 and the returning path 9 can be made smaller than a space between the feeding path and the returning path of the conventional apparatus, whereby since the process cartridge 5 can be made thinner in thickness and smaller in size, the main body 2 (the laser printer 1) can be made thinner in thickness and smaller in size accordingly.

Third Embodiment

Next, a third embodiment of the invention will be described in detail while referring to the drawings. In addition, since this embodiment is such that a part of the configurations of the first and second embodiments, specifically, the configurations of the process cartridge 5 and the returning path 9 thereof (the configuration of a part of the returning path 9 formed at the cartridge frame 51) are modified, same reference numerals will be imparted to similar elements to those of the first and second embodiments, and the description thereof will be omitted here.

Figure 8:
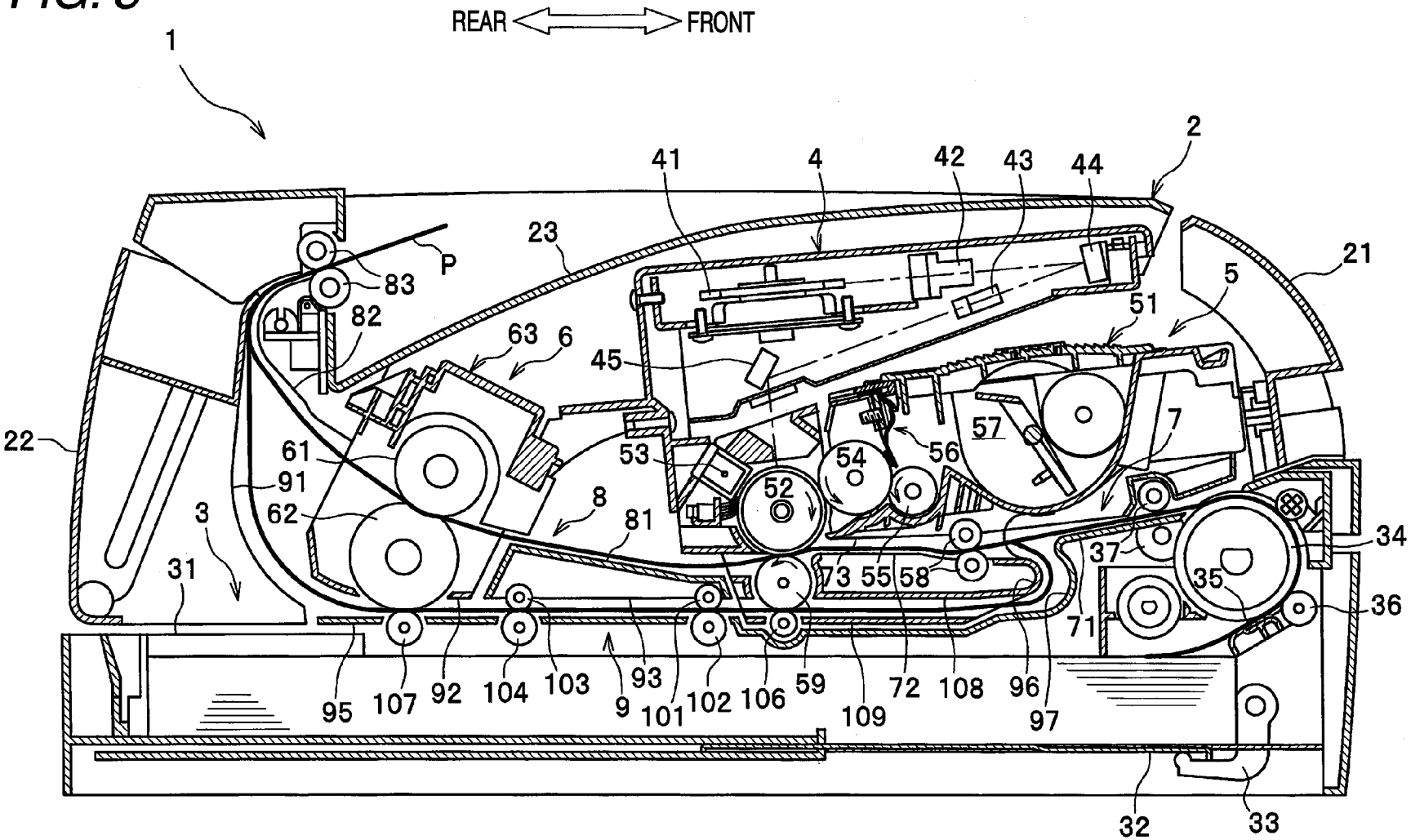
FIG. 8 is a sectional view showing an overall configuration of a laser printer according to a third embodiment.
Figure 9:
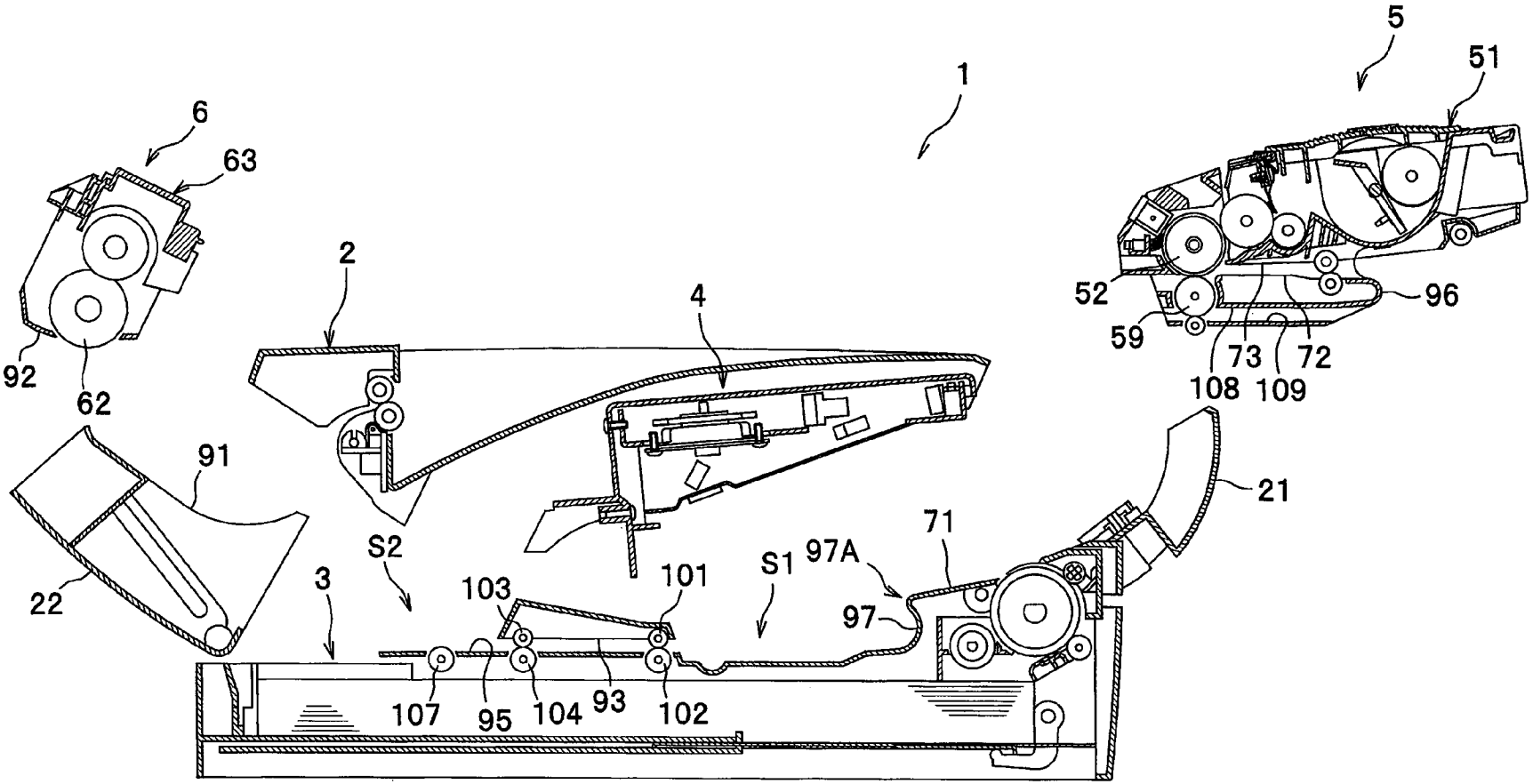
FIG. 9 is a sectional view showing a state in which a process cartridge and a fixing device of the laser printer according to the third embodiment are detached therefrom.

In the drawings which are referred to, FIG. 8 is a sectional view showing an overall configuration of a laser printer according the third embodiment, and FIG. 9 is a sectional view showing a state in which a process cartridge and a fixing unit are detached from the laser printer according to the third embodiment.

<Configuration of Process Cartridge>

As shown in FIG. 8, a process cartridge 5 of this embodiment includes a photosensitive drum 52, a scorotron charger 53, a developing roller 54, a feeding roller 55, a layer thickness control blade 56, a toner storage unit 57, conveyer rollers 58, a transfer roller 59 and a conveyer roller 106, which are provided in a cartridge frame 51.

<Configuration of Returning Path>

The returning path 9 of this embodiment is mainly defined by: a guide wall 91; guide walls 92, 93, 108 which define an upper wall extending in the longitudinal direction; guide walls 95, 109 which oppose the guide walls 92, 93, 108 so as to define a lower wall; and curved portions 96, 97 where the conveying direction of a sheet P is changed so that the sheet P is returned to a feeding path 7. Conveyer rollers 101 to 104, 106, 107 are disposed on this returning path 9.

The guide wall 108 defines the returning path 9 to continue from a front side of the guide wall 93 and defines an upper wall of the returning path 9. The guide wall 108 continues on the front side thereof to the curved portion 96, which is provided to curve from a front side upwards and then to a rear side thereof to continue to the guide wall 72. A lower portion of the transfer roller 59 is disposed on this guide wall 108 to be exposed on the returning path 9.

The guide wall 109 is provided below the guide wall 108 to oppose the guide wall 108 and continues to a front side of the guide wall 95 to define a lower wall of the returning path 9, while a front side of the guide wall 109 continues to the curved portion 97. The conveyer roller 106, which opposes and contacts the transfer roller 59 from therebelow, is provided on the guide wall 109, and the conveyer roller 106 is driven to rotate by the rotation of the transfer roller 59 so as to convey a sheet P from the rear side to the front side.

As shown in FIGS. 8 and 9, the guide walls 108, 109 define an upper wall and a lower wall, respectively, of a through hole provided in the cartridge frame 51 to extend substantially horizontally on an opposite side of the photosensitive drum 52 across the transfer roller 59. Namely, the returning path 9 of this embodiment is formed to pass through the cartridge frame 51.

As has been described in the first embodiment, the comb-shaped portion is formed (see FIGS. 4A to 4D) also on the curved portion and an upper portion 97A (see FIG. 9) of the curved portion 97. By this configuration, since the cartridge frame 51 can be removed from its attached state by causing protruding portions of the comb-shaped portion of the curved portion 96 to pass through recessed portions of the comb-shaped portion of the upper portion 97A, as shown in FIG. 9, the process cartridge 5 can be removed from the main body 2 on an upstream side (a front side) of the feeding path 7 in the conveying direction.

Thus, as has been described heretofore, this embodiment can provide the same advantage as those of the first and second embodiments.

Furthermore, since a part (the guide walls 108, 109) of the returning path 9 is defined by the upper wall and the lower wall of the through hole provided in the cartridge frame 51, a sheet P jammed in this portion (the through hole) can be removed by removing the process cartridge.

Thus, while the embodiments of the invention have been described heretofore, the invention is not limited to the embodiments. Specifically, the configuration of the invention can be modified as required without departing from the spirit and scope thereof.

In the embodiments, while the process cartridge 5 is described as including the photosensitive drum 52, the developing roller 54 and the toner storage unit 57 which are provided in the cartridge frame 51, the invention is not limited thereto. For example, the process cartridge may include a drum cartridge including a photosensitive drum and a developing cartridge including a developing roller and a toner storage unit. Namely, the cartridge frame 51 may include a drum frame which supports a photosensitive drum and a developing frame which is detachably attached to the drum frame and which not only supports a developing roller but also defines a toner storage unit. Furthermore, the developing frame may include a frame which supports the developing frame and a toner box which is detachably attached to the developing frame and which defines the toner storage unit.

In the embodiments, while the examples have been described separately in which the external wall surface of the cartridge frame 51 defines the one side wall (the guide wall 94 or 98) of the returning path 9 (the first and second embodiments) and the example in which the returning path 9 is formed to pass through the cartridge frame 51 (the guide walls 108, 109, the third embodiment), the invention is not limited thereto. Namely, the invention may include a mode which includes both the examples.

In the embodiments, while the examples have been described separately in which the guide walls 94, 98 (the returning path formed at the cartridge frame) are provided on either the upstream side or the downstream side of the transfer position in the conveying direction (the longitudinal direction) in the feeding path 7, the invention is not limited thereto. Namely, the guide walls may be provided on both the upstream side and the downstream side of the transfer position in the conveying direction in the feeding path.

In the embodiments, while the example has been illustrated in which one (the side wall, the curved portion 96) of the curved portions which changes the conveying direction of the sheet P to return it to the feeding path 7 is provided in the cartridge frame 51, the invention is not limited thereto, and hence, both the walls which define the curved portions may be provided on the cartridge frame side.

In the embodiments, while the transfer rollers 59, 74 have been described as the examples of the transfer member, the invention is not limited thereto, and hence, for example, a corotron type transfer member or a scorotron transfer member may be adopted.

In the embodiments, while the various types of gears have been described as the examples of the driving force transmission unit, the invention is not limited thereto, and hence, for example, rollers or belts may be adopted instead. In addition, two or more types of driving force transmission unit such as gears, rollers or belts may be combined.

In the embodiments, while the example has been described in which the driving force from the motor 100A, 100B is transmitted to the second or fourth driving force transmission unit (the intermediate gears 113, 117, the roller gears 114, 118) via the first or third driving force transmission unit (the drive gears 111, 115, the drum gear 112, the pressure roller 116 and the like), so as to drive to rotate the conveyer roller 102 or 103, the invention is not limited thereto. For example, the driving force from the motor 100A, 100B may be transmitted to the conveyer rollers 101, 104 to drive the conveyer rollers 101, 104 to rotate. In addition, the driving force from the motor may be transmitted to the plurality of conveyer rollers (at least one of the pair of conveyer rollers which is provided separately from the conveyer rollers 101 to 104).

In the embodiments, while the heating roller 61 has been illustrated as the example of the heating member, the invention is not limited thereto, and hence, for example, a heating member may be adopted which is used in a fixing device of film fixing type.

In the embodiments, while the example has been described in which the attaching and detaching (replacement) of the process cartridge 5 is implemented on the upstream side (the front side) in the conveying direction of the feeding path 7, the invention is not limited thereto, and hence, for example, the attaching and detaching of the process cartridge 5 may be implemented from the left side or right side of the main body 2 or from an upper side of the main body 2. This is true with the attaching and detaching of the fixing device 6.

In the embodiments, while the example has been illustrated in which the plurality of ribs 94A are provided on the guide wall 94 (see FIG. 3), ribs like these can be provided also on the guide walls 71 to 73, 75, 81, 91 to 93, 95, 98, 99, 108, 109, as well as the curved portions 96, 97, 121, 122.

According to the above-described image forming apparatus and process cartridge, a part (the returning path formed at the cartridge frame) of the returning path can be removed by removing the process cartridge which is detachably attached. Therefore, the recording sheet jammed in the returning path can easily be removed from space formed where the part of the returning path is removed.

Here, in the above embodiments, the "path" in the feeding path and the returning path means wall surfaces (guide walls) which define space through which a recording sheet can pass. In addition, the expression that a part of the path is formed means that a part of the wall surfaces which define the space through which a recording sheet can pass is included in the cartridge frame, that is, a part of the guide walls is formed at the cartridge frame.

What is claimed is:

1. An image forming apparatus comprising:

a main body;

a process cartridge detachably attachable to the main body, the process cartridge comprising an image carrier configured to carry a developer image thereon and a cartridge frame;

a feeding path configured to feed a recording sheet to a transfer position where the developer image carried on the image carrier is transferred to the recording sheet; and a returning path configured to return the recording sheet that has passed the transfer position to the feeding path, wherein the cartridge frame defines at least a part of the feeding path and at least a part of the returning path.

2. The image forming apparatus according to claim 1, wherein an external wall surface of the cartridge frame defines one side wall of the returning path.

3. The image forming apparatus according to claim 1, wherein the returning path is formed in the cartridge frame to pass through the cartridge frame.

4. The image forming apparatus according to claim 1, wherein the returning path formed at the cartridge frame includes a portion located upstream in a conveying direction in the feeding path from the transfer position of the cartridge frame.

5. The image forming apparatus according to claim 4, wherein the returning path formed at the cartridge frame includes a curved portion that changes the conveying direction of the recording sheet to allow the recording sheet to return to the feeding path.

6. The image forming apparatus according to claim 1, wherein the returning path formed at the cartridge frame includes a portion located downstream in a conveying direction in the feeding path from the transfer position of the cartridge frame.

7. The image forming apparatus according to claim 1, further comprising a transfer member configured to transfer the developer image formed on the image carrier to the recording sheet, wherein the returning path formed at the cartridge frame is located across the transfer member from the image carrier.

8. The image forming apparatus according to claim 7, wherein the transfer member includes a transfer roller, and wherein the transfer roller is disposed on the returning path formed at the cartridge frame and configured to convey the recording sheet along the returning path on the opposite side of the image carrier.

9. The image forming apparatus according to claim 1, further comprising:

a motor; and a conveyer roller configured to convey the recording sheet on the returning path, wherein the process cartridge comprises a first driving force transmission unit configured to transmit driving force from the motor to the image carrier, and wherein the main body comprises a second driving force transmission unit configured to transmit the driving force from the first driving force transmission unit to the conveyer roller.

10. The image forming apparatus according to claim 1, further comprising a fixing unit that comprises a heating member and a pressure roller, the fixing unit being detachably attachable to the main body and configured to nip and convey the recording sheet, to which the developer image has been transferred, by the heating member and the pressure roller such that the developer image is heated and fixed on the recording sheet, wherein the pressure roller is located on the returning path and configured to convey the recording sheet.

11. The image forming apparatus according to claim 1, further comprising:

a fixing unit that comprises a heating member and a pressure roller, the fixing unit being detachably attachable to the main body and configured to nip and convey the recording sheet, to which the developer image has been transferred, by the heating member and the pressure roller such that the developer image is heated and fixed on the recording sheet;

a motor; and a conveyer roller configured to convey the recording sheet in the returning path, wherein the fixing unit comprises a first driving force transmission unit configured to transmit driving force from the motor to the pressure roller, and wherein the main body comprises a second driving force transmission unit configured to transmit the driving force from the first driving force transmission unit to the conveyer roller.

12. The image forming apparatus according to claim 1, wherein the process cartridge is detachably attachable to the main body through a portion of the main body upstream in the conveying direction in the feeding path.

13. A process cartridge comprising:

an image carrier configured to carry a developer image; and a cartridge frame, wherein the cartridge frame defines at least a part of a feeding path through which a recording sheet is allowed to be fed to a transfer position where the developer image on the imager carrier is transferred to the recording sheet and at least a part of a returning path through which the recording sheet that has passed the transfer position is allowed to be returned to the feeding path.

14. The process cartridge according to claim 13, wherein a plurality of ribs are provided on a surface of the returning path formed at the cartridge frame which faces to the recording sheet being conveyed and extends along a conveying direction of the recording sheet.

* * * * *